US007395956B1

(12) United States Patent
Bell et al.

(10) Patent No.: US 7,395,956 B1
(45) Date of Patent: Jul. 8, 2008

(54) BALLOT BOX

(75) Inventors: Richard Bell, Crumlin (GB); Patrick McGonagle, Northern Ireland (GB)

(73) Assignee: Pakflatt Limited, Londonderry (GB)

( * ) Notice: Subject to any disclaimer, the term of this patent is extended or adjusted under 35 U.S.C. 154(b) by 0 days.

(21) Appl. No.: 11/845,464

(22) Filed: Aug. 27, 2007

(51) Int. Cl.
*G07C 13/02* (2006.01)

(52) U.S. Cl. ..... 232/2; 220/4.33

(58) Field of Classification Search ..... 232/2, 232/3; 220/4.28, 4.33, 615–616, 622, 682–684, 220/692–693
See application file for complete search history.

(56) References Cited

U.S. PATENT DOCUMENTS 387,572 A * 8/1888 Wood ..... 232/2
674,514 A * 5/1901 McNulty ..... 232/2
1,313,101 A * 8/1919 McNulty ..... 232/2
1,673,769 A * 6/1928 Graham ..... 220/6
1,828,088 A * 10/1931 Robinson ..... 220/683
3,266,656 A * 8/1966 Kridle ..... 220/4.28
5,529,199 A * 6/1996 Foster ..... 220/4.28
6,648,144 B2 * 11/2003 Vogel ..... 209/554

FOREIGN PATENT DOCUMENTS

WO WO 98/46489 10/1998

* cited by examiner

*Primary Examiner*—William L. Miller
(74) *Attorney, Agent, or Firm*—RatnerPrestia

(57) ABSTRACT

The present invention provides a ballot box comprising a base, a sidewall secured to the base and defining an interior volume therewith, a lid releasably secured to the sidewall and enclosing said interior volume, and a slot provided in the ballot box to enable posting of ballots into the interior volume, wherein the sidewall comprises a modular assembly of spaced apart elongate struts extending between the base and the lid and a plurality of panels each disposed between a pair of adjacent struts to enclose said interior volume.

18 Claims, 10 Drawing Sheets

BALLOT BOX

The present invention relates to a ballot box.

Every year, in almost every country, a huge volume of voting is undertaken, for a huge number of different reasons. However, the majority of voting involves local, regional and national elections, depending on the country in question. Standard mass produced ballot boxes are not suitable for all voting occasions. Such conventional ballot boxes have many disadvantages including that they tend to be produced in one size, which may be too large and cumbersome for smaller volume voting occasions. Conventional ballot boxes can also be expensive to manufacture. In particular, any changes which need to be made to a standard shape of ballot box generally require expensive and time-consuming adjustments to be made to a manufacturing mould, or use of a new mould. Another disadvantage is that conventional ballot boxes can be difficult to transport due to their weight and bulk.

It is therefore an object of the present invention to mitigate one or more disadvantages of the prior art.

According to the present invention, there is provided a ballot box comprising:

a base;

a sidewall secured to the base and defining an interior volume therewith;

a lid releasably secured to the sidewall and enclosing said interior volume; and a slot provided in the ballot box to enable posting of ballots into the interior volume;

wherein the sidewall comprises a modular assembly of spaced apart elongate struts extending between the base and the lid and a plurality of panels each disposed between a pair of adjacent struts to enclose said interior volume.

Preferably, the ballot box further comprises a plurality of elongate rods, each rod being associated with one of said struts and securing said one of said struts to both the base and the lid.

Preferably, each rod further comprises a releasable fastener at an end thereof to permit assembly and disassembly of the box.

Most preferably, each rod is in the form of a bolt extending through the strut and each fastener is a complementary nut.

Preferably, each strut comprises a pair of grooves, each adapted to receive an edge of a panel.

Optionally, the pair of grooves on at least one strut are directed at right angles to one another and run along the length of said strut, whereby said strut mates with a pair of orthogonally directed panels.

Preferably, the cross section of said strut is generally C-shaped to define a quarter circle having said grooves at either end thereof.

Further, preferably, the cross section of the strut further comprises a strengthening rib connecting said grooves internally of the quarter circle.

Preferably, the strengthening rib is provided with means for receiving and mating with a rod running through the length of the strut.

Further, preferably, the strengthening rib and the quarter circle surface define in cross section an interior strut volume, and the means for receiving and mating with the rod are internal within this interior strut volume.

Preferably, the struts are extruded lengths of material with a constant cross section which may be cut to any desired length, thereby facilitating the formation of sidewalls of different heights.

Further, preferably, the panels are extruded lengths of material with a constant cross section which may be cut to any desired length, thereby facilitating the formation of sidewalls of different heights.

Optionally, the panels and the struts are arranged for a press fit with one another.

Further optionally, the panels and the struts are arranged for an interference fit with one another.

Preferably, the slot is provided in the lid of the ballot box. Alternatively or additionally, the slot may be provided in the sidewall of the ballot box.

Optionally, some or all of the side panels may be translucent and/or transparent. Further optionally, some or all of the struts may be translucent and/or transparent.

Alternatively, some or all of the side panels and/or the struts may be opaque.

An embodiment of the present invention will now be described with reference to the accompanying drawings, in which:—

Figure 1:
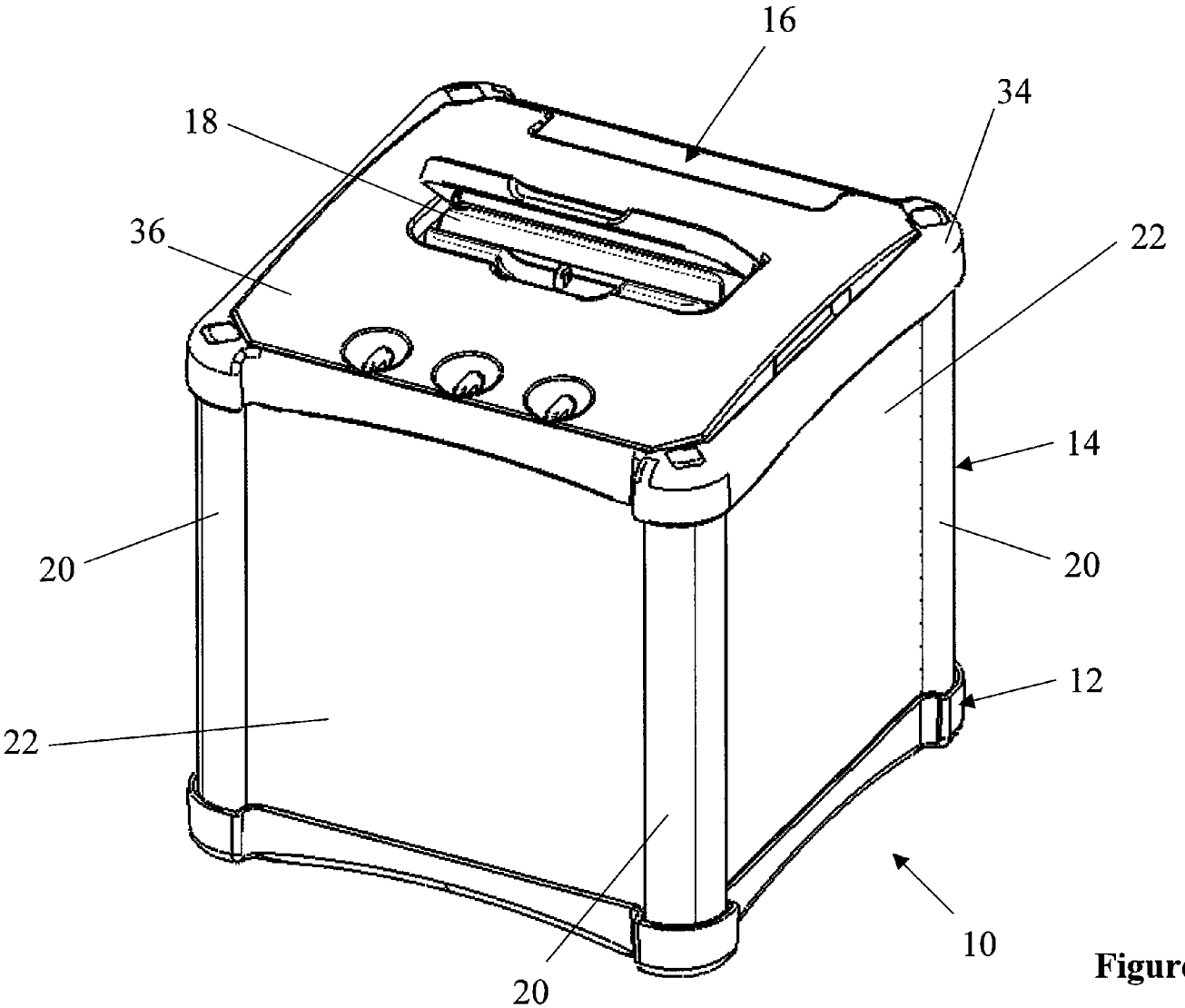
FIG. 1 is a perspective view of a ballot box according to a preferred embodiment of the present invention.

Referring to the accompanying drawings, there is provided a ballot box generally indicated as 10, according to a preferred embodiment of the present invention. The ballot box 10 preferably comprises a base 12 and a sidewall 14 secured to the base 12 and defining an interior volume therewith. The ballot box 10 also preferably comprises a lid 16 releasably secured to the sidewall 14 and which encloses the interior volume. A slot 18 is provided in the lid 16 to enable posting of ballots (not shown) into the interior volume of the ballot box 10.

The sidewall 14 conveniently comprises a modular assembly of four spaced apart elongate struts 20 and four panels 22 as shown in FIGS. 1-3 and 9-10 for example. In the preferred embodiment, each of the struts 20 extends between the base 12 and the lid 16, and each of the panels 22 is disposed between a pair of adjacent struts 20. The ballot box 10 also preferably includes four elongate rods 26 as shown in FIGS. 3-9. Each rod 26 is preferably approximately 6 mm in diameter but is not limited thereto. Each rod 26 is adapted to secure one of the struts 20 to both the base 12 and the lid 16. This modular assembly of the ballot box 10 conveniently provides an easy assembly of the ballot box 10 and other advantages as will be described in more detail hereinafter.

Figure 6:
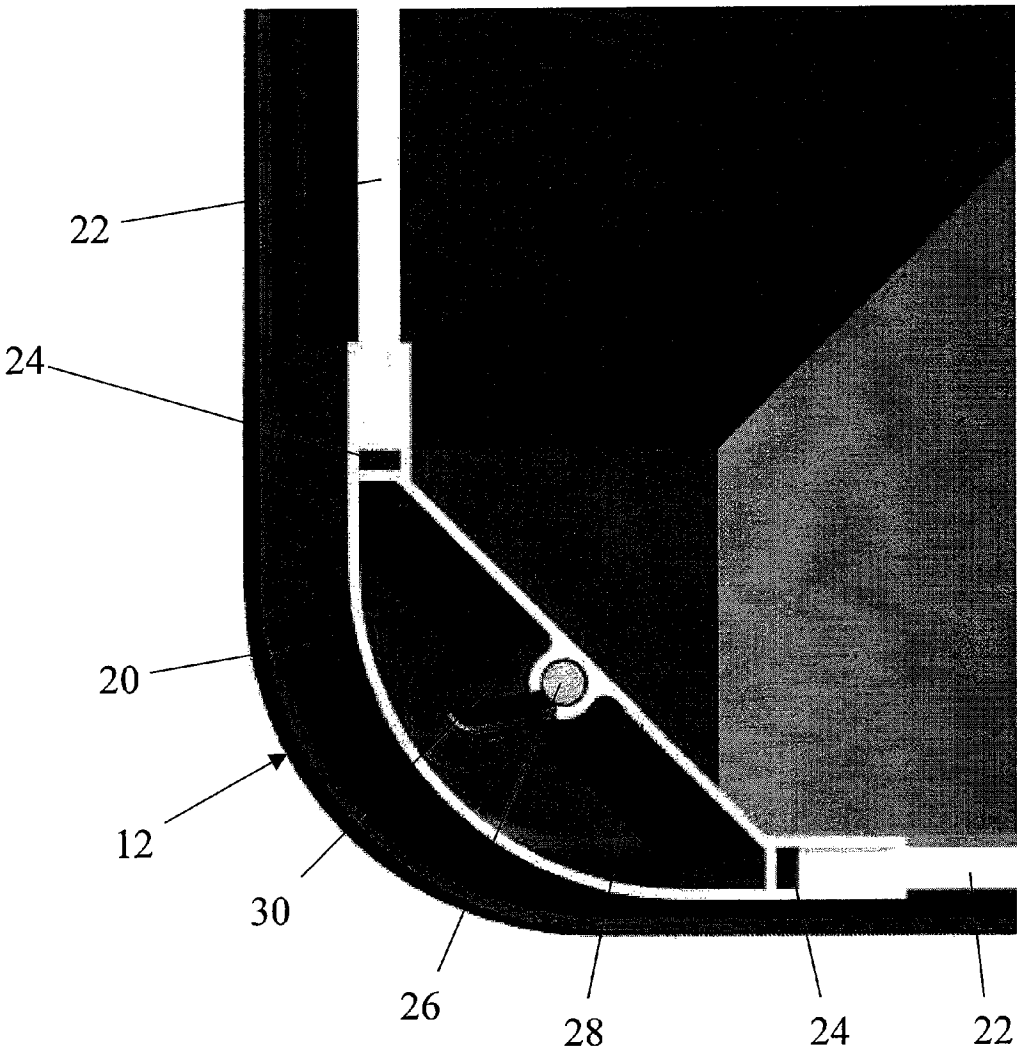
FIG. 6 is a cross sectional view of a portion of the ballot box taken along the line A-A shown in FIG. 4.

Bach strut 20 preferably comprises a pair of grooves 24 as shown in FIG. 6. Each groove 24 in a pair of grooves is preferably directed at right angles to the other groove 24, and preferably runs the length of the respective strut 20. Referring to FIG. 6 for example, it can be seen that the cross section of the strut 20 is generally C-shaped to define a quarter circle having the grooves 24 provided at either end thereof. In this way, the grooves 24 are capable of receiving a pair of orthogonally directed panels 22, referring again to FIG. 6 and also generally to FIGS. 1-3, 9 and 10. The struts 20 and panels 22 are conveniently arranged for a press fit with one another to facilitate a relative quick and easy assembly and disassembly of the side wall, as will described in more detail hereinafter. In the embodiment shown in the drawings, the struts 20 are opaque and the panels 22 are transparent, resulting in a partially transparent sidewall 14.

Figure 8:
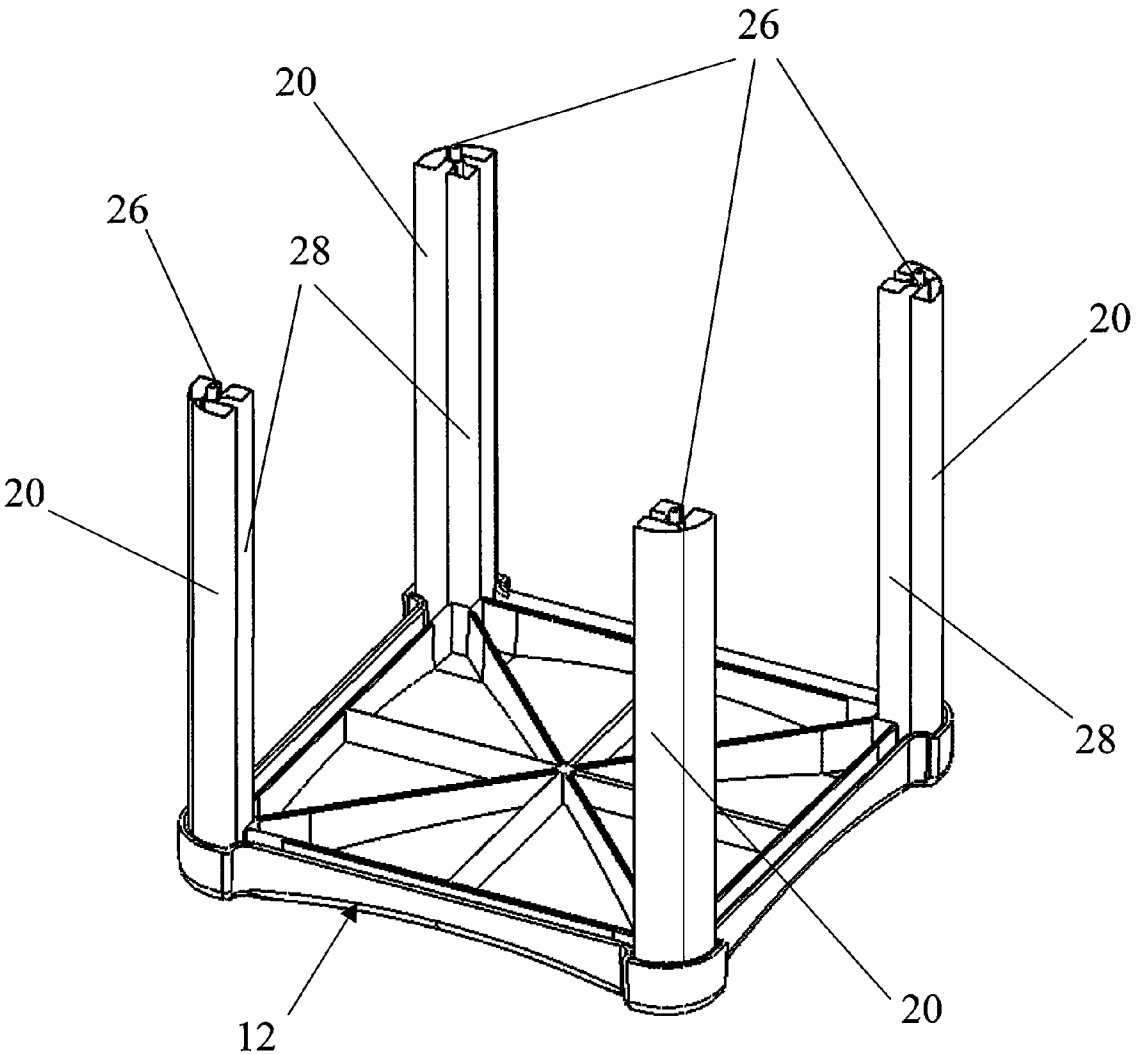
FIG. 8 shows the ballot box in a second stage of assembly.
Figure 9:
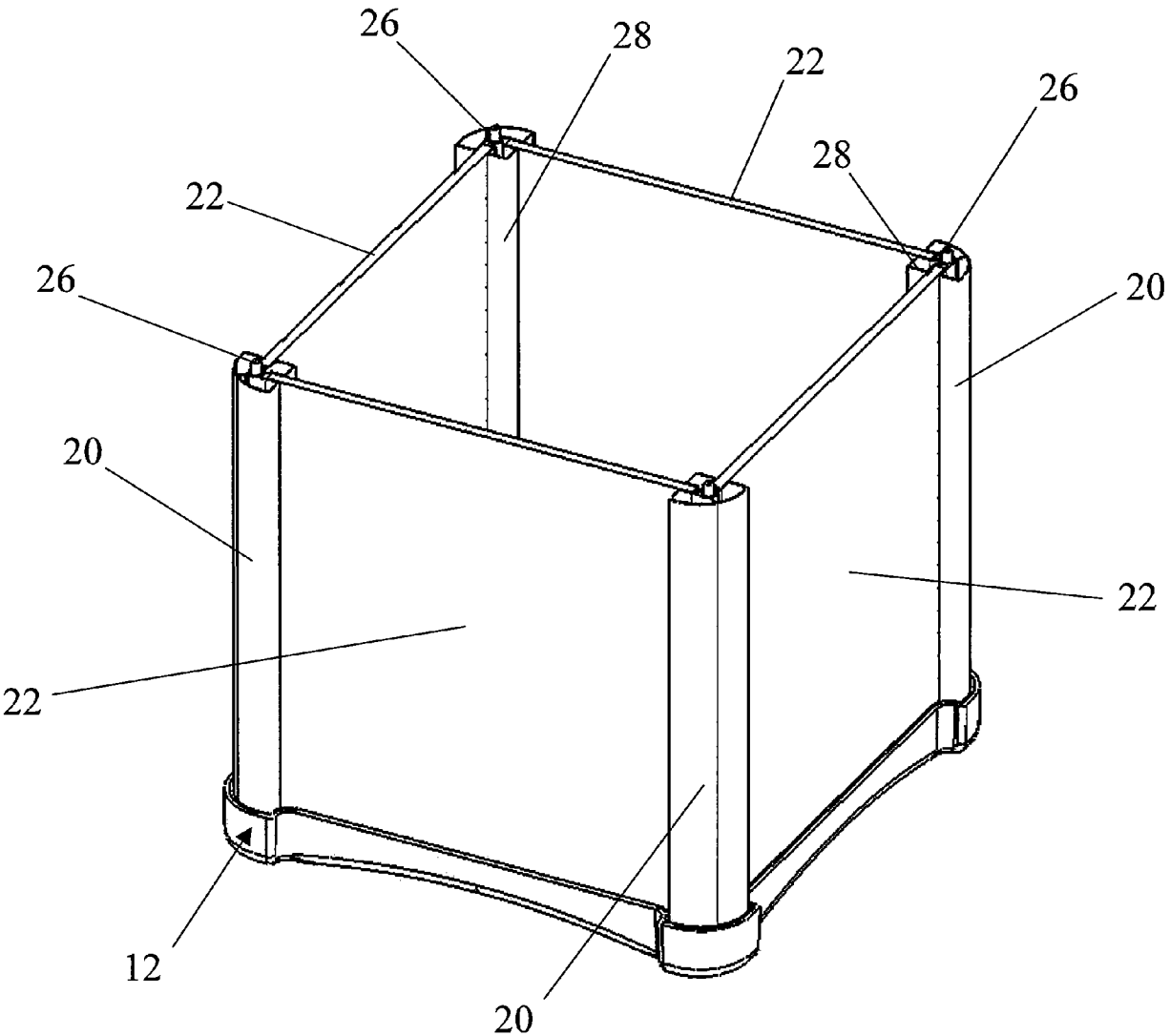
FIG. 9 shows the ballot box in a third stage of assembly.

Referring to FIGS. 6, 8 and 9, the strut 20 comprises a strengthening rib 28 which connects the grooves 24 of the strut 20. The strengthening rib 28 is also provided with means for receiving and mating with the rod 26 which runs the length of the strut 20 and is used to secure the strut 20 to both the base 12 and the lid 16. The means in the preferred embodiment is a collar 30 which partially surrounds the rod 26. The collar 30 preferably extends along the length of the strut 20, but the invention is not limited thereto. Additionally, as will be seen from FIG. 6, the strengthening rib 28 and quarter circle inner surface define in cross section an interior strut volume, and the collar 30 is preferably internal within this interior strut volume. Each rod 26 is preferably in the form of a bolt and is provided with a complementary nut 32.

Figure 2:
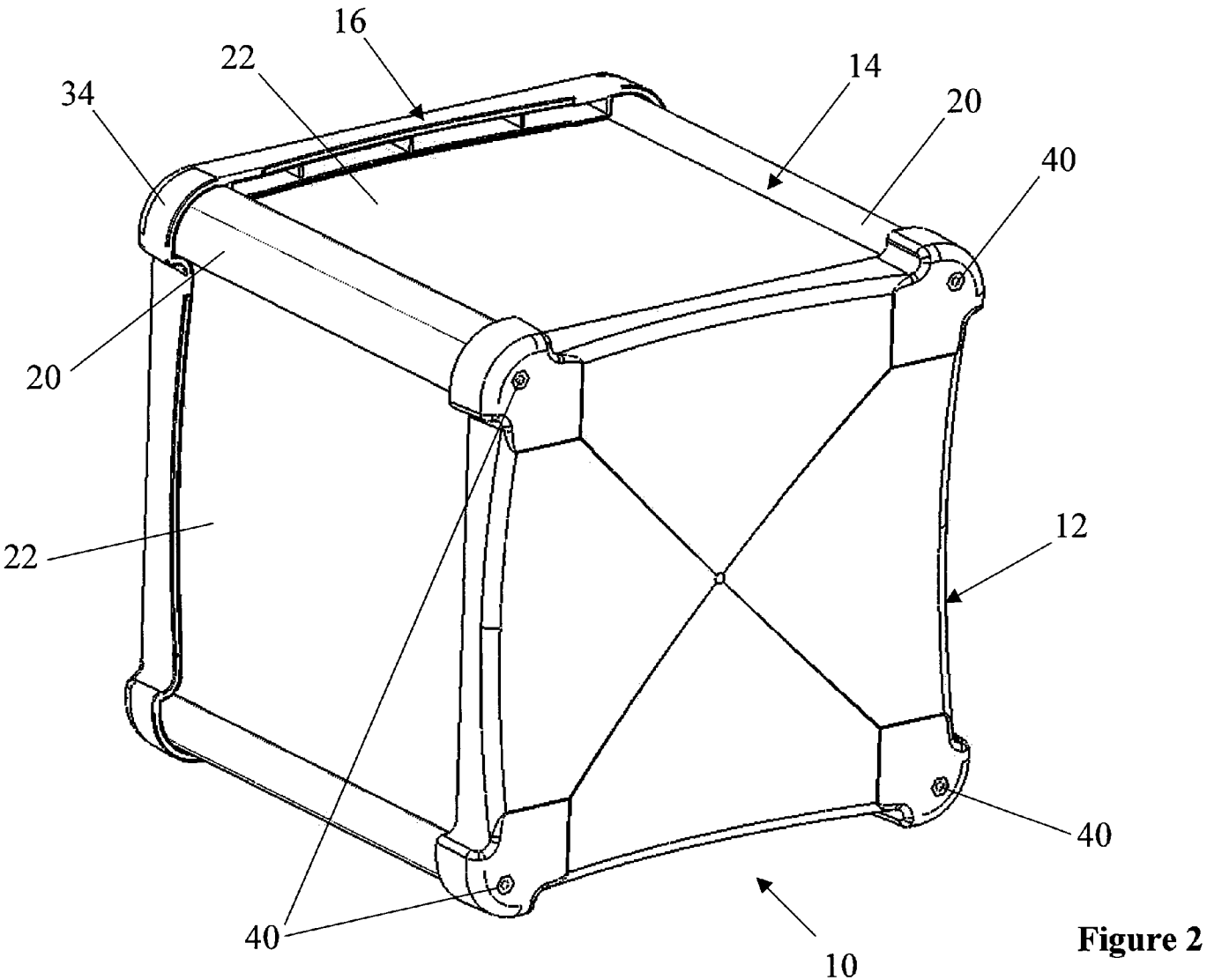
FIG. 2 is a view of the underside of the ballot box of FIG. 1.
Figure 3:
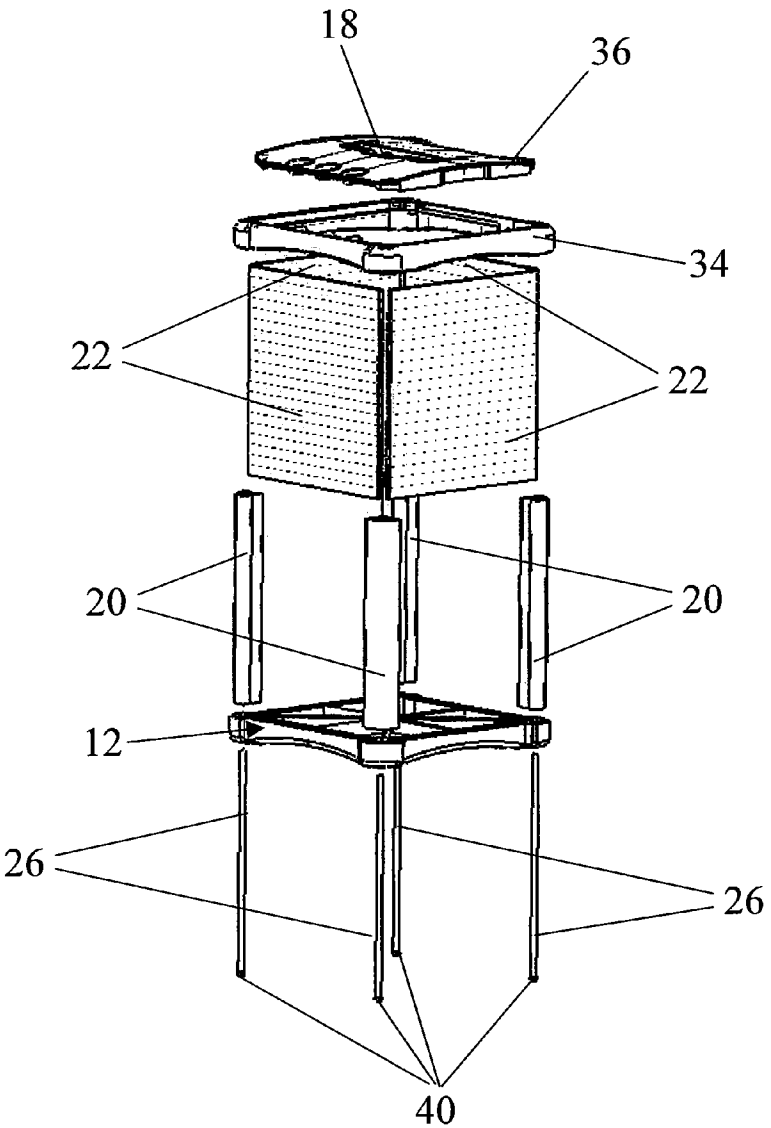
FIG. 3 is an exploded view of the ballot box.
Figure 4:
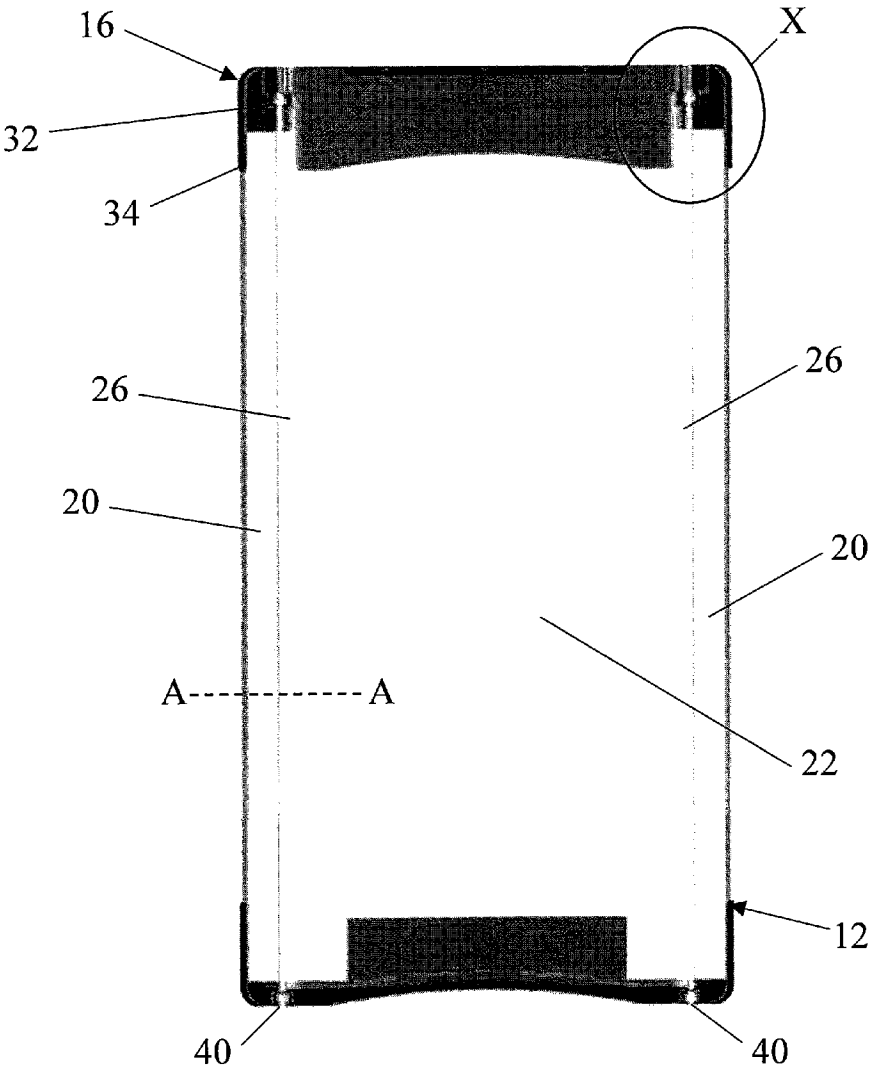
FIG. 4 is a longitudinal sectional view of the ballot box.
Figure 7:
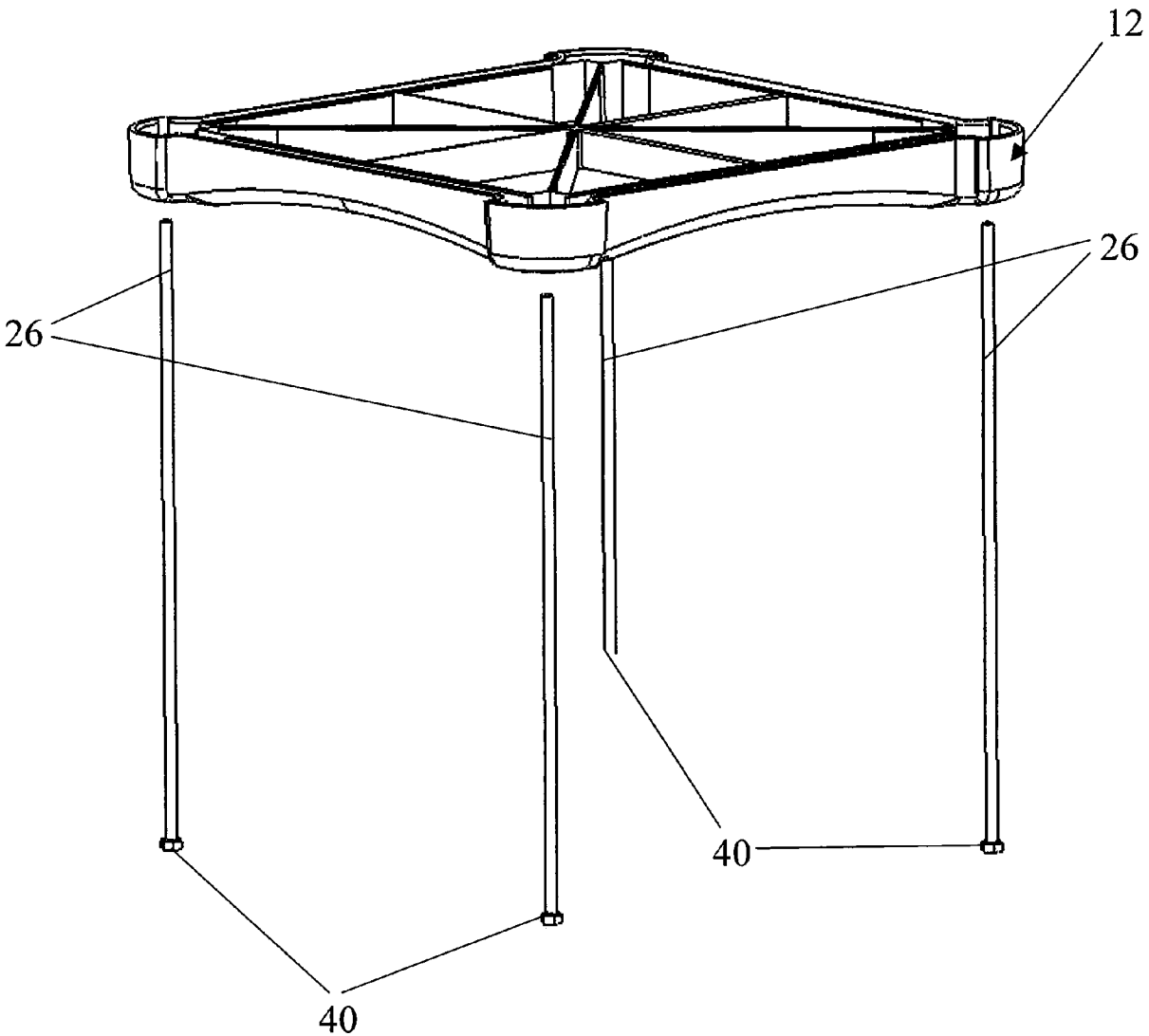
FIG. 7 shows the ballot box in a first stage of assembly.

The ballot box 10 of the present invention can be assembled as follows. Referring to FIGS. 3 and 7, the rods 26 are inserted into suitably shaped apertures (not shown) provided in the base 12. Once the rods 26 are in place in the base 12, the dome-shaped heads 40 act to retain the rods 26 in place in the base 12. The apertures are preferably provided within recesses of the base 12, such that, in use, the top of the dome-shaped heads 40 lie substantially flush with the main outer surface of the base 12 as shown in FIG. 2. In this way, the dome-shaped heads 40 not only reduce the number of fixing means required to assemble the ballot box 10, but it also prevents tampering from the underside of the ballot box 10.

Each of the struts 20 is then put in place by inserting the respective rod 26 into the aperture defined by the collar 30, such that the collar 30 is used to guide each strut 20 into place. As shown in FIG. 8, at this stage, a portion of the rods 26 projects beyond the free ends of the struts 20. The panels 22 are then slotted into the grooves 24 of the struts 20 (and optionally into grooves (not shown) provided in the base 12) to form the sidewall, as shown in FIG. 9.

Figure 5:
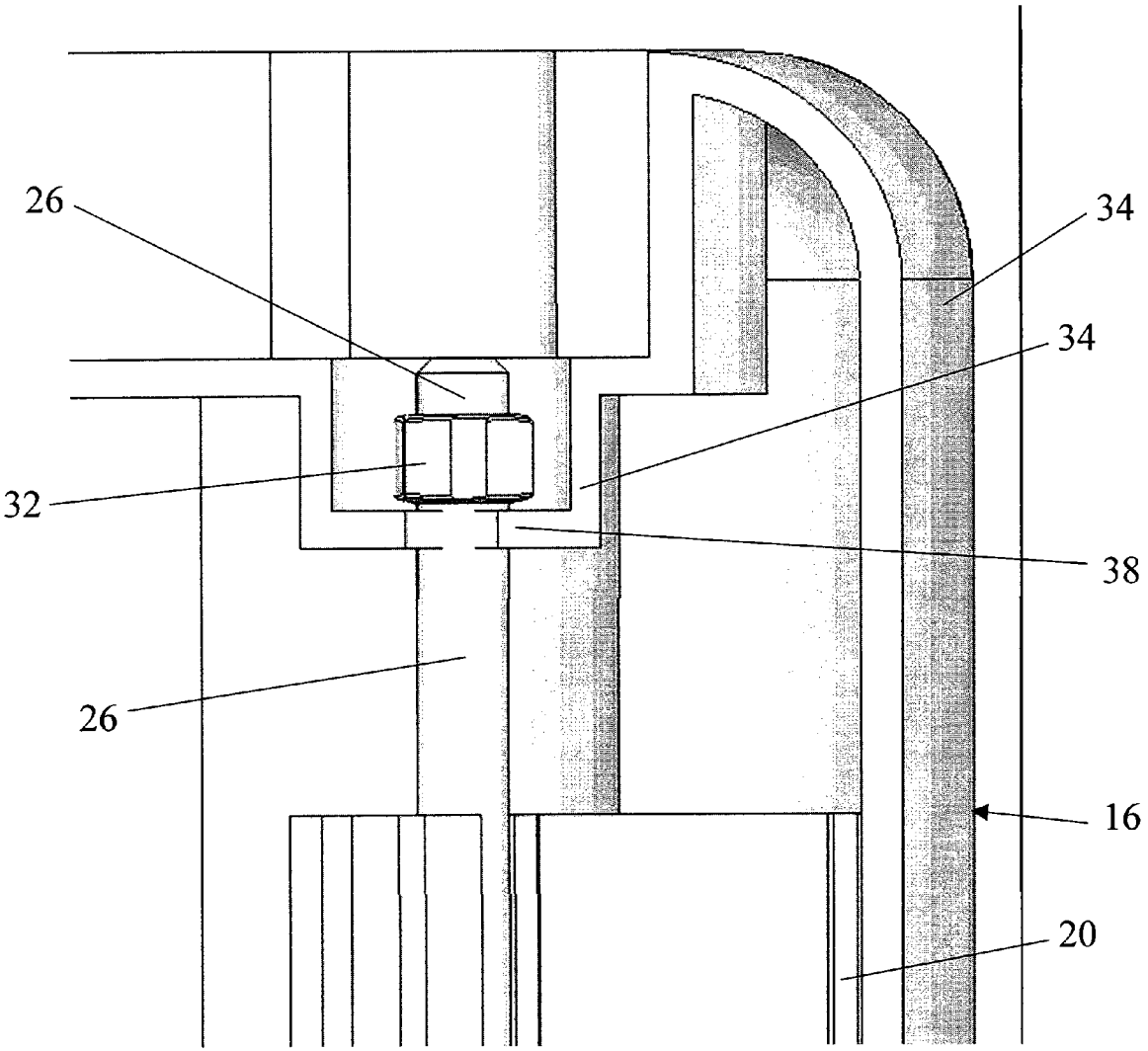
FIG. 5 is an enlarged sectional view of a portion of the ballot box generally indicated as X in FIG. 4.
Figure 10:
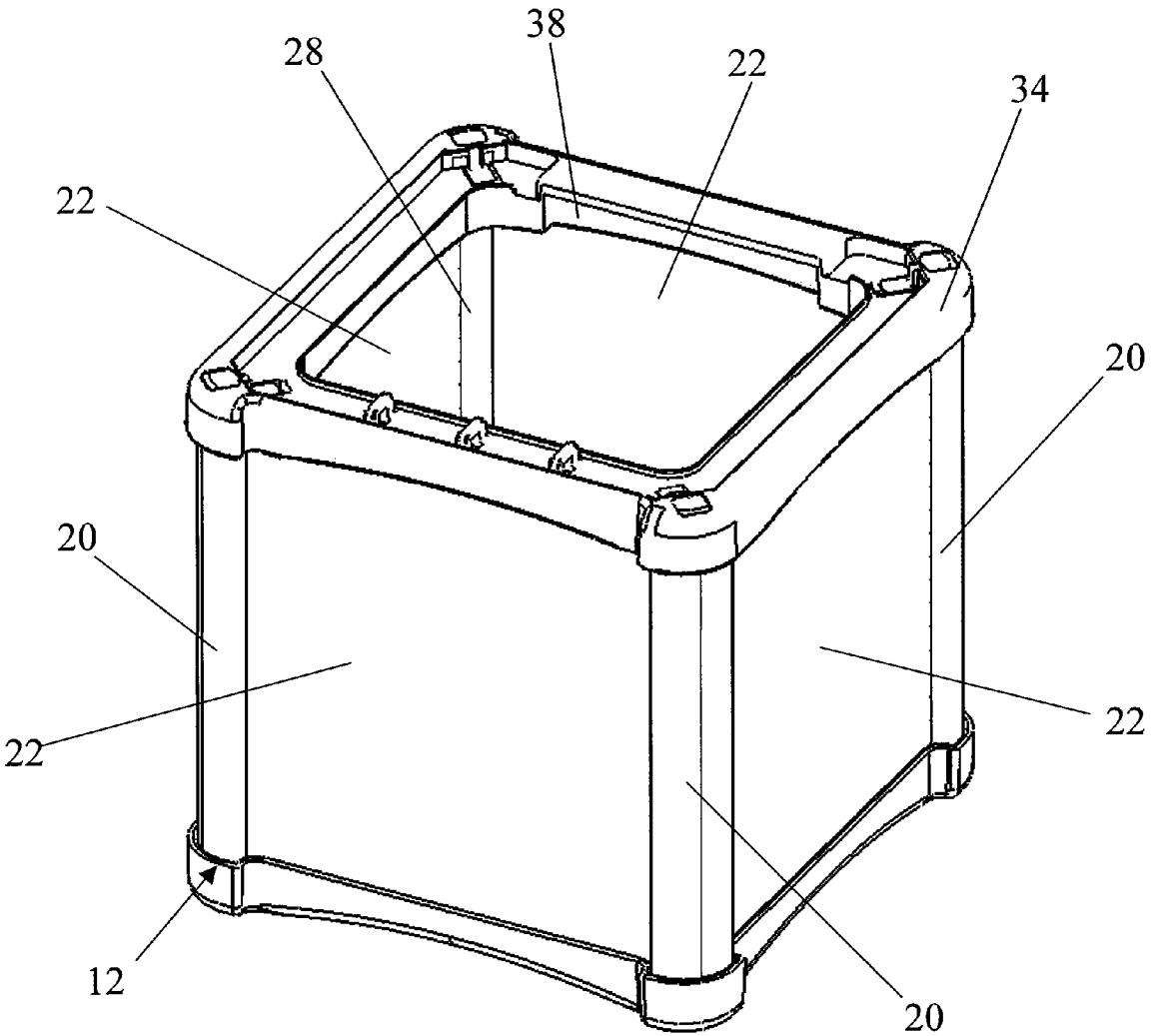
FIG. 10 shows the ballot box in a fourth stage of assembly.

The lid 16 preferably comprises two sections as shown in FIGS. 1-3 for example, namely a lid collar 34 and a cover 36. The lid 16 is preferably assembled as follows. The lid collar 34 comprising four suitably shaped and positioned apertures is placed over the projecting ends of the rods 26 (shown in FIG. 8), so that the rods 26 are received within the apertures of the lid collar 34. A nut 32 is placed over each rod 26 and securely fastened thereto, as shown in FIG. 5 for example, to retain the lid collar 34 in place. At this stage, the ballot box 10 is assembled as shown in FIG. 10.

The cover 36 is then placed on the ballot box 10 which cover 36 rests on a lip 38 of the lid collar 34. Once the cover 36 is in place it lies substantially flush with the top surface of the lid collar 34, thereby producing a smooth finish, as shown in FIG. 1 for example. Tamper evident seals (not shown) are preferably applied to the lid 16 at this stage, to secure the cover 36 to the lid collar 34, however it will be appreciated that any other suitable means may be used. One assembled, the ballot box 10 is ready for use and ballots (not shown) can be inserted through the slot 18.

The ballot box 10 provides many advantages over conventional ballot boxes. For example, the ballot box 10 is quick and easy to assemble and disassemble as will be appreciated from the description above, meaning that the ballot box 10 is easy to transport, for example in a flat-pack arrangement. Once assembled, the ballot box 10 is conveniently tamper-proof at both ends, by means of the tamper-evident seals provided on the lid 16 and the presence of the dome shaped heads 14 on the underside of the base 12. The sidewall 14 is also tamper-proof due to its construction of interlocking panels 22 and struts 20.

A further advantage of the ballot box 10 of the present invention is that either the panels 22 or the struts 20, or preferably both, are extruded lengths of material which a constant cross section which may be cut to any desired length. The struts 20 are preferably aluminium extrusions, but it will be appreciated that they may be made of any other suitable material including metals, alloys, polymers and the like. The panels 22 are preferably polycarbonate extrusions, but it will be appreciated that the panels 22 may also be made of any other suitable material including other plastics and polymers, but not limiting the invention thereto. In this way, the sidewall 14 may be easily constructed according to the height necessary. For example, for a ballot box 10 needing a relatively small interior volume, panels 22 and struts 20 cut to a particular suitable size will be used to make the sidewall 14. Similarly, if a large ballot box 10 is required, much longer panels 22 and struts 20 may be used to make the sidewall 14. This invention therefore provides an advantage over conventional ballot boxes of one size.

It is envisaged that the ballot box 10 may be manufactured in the form of a kit, where, for example, the ballot box 10 is provided in an unassembled form, and e.g. three sets of differently sized panels 22 and struts 20 are provided, so that three sidewalls of different lengths can be easily assembled and disassembled as necessary by the customer.

The strengthening rib 28 and associated collar 30 conveniently provide strength and rigidity to the struts 20, thereby strengthening the sidewall 14 and overall ballot box 10. Therefore, although the ballot box 10 has the advantage of being assembled in a quick and easy fashion, the present invention provides the additional advantage of being of sturdy construction. This provides the ballot box 10 with an advantage over conventional ballot boxes whose sidewalls may be prone to buckling under any stress.

Due to the partial transparency of the sidewall 14 of the embodiment described herein, it is possible to see how the full the interior volume of the ballot box 10 is, and therefore determine whether another ballot box 10 is required.

The present invention is not limited to the embodiment described herein. For example, it will be apparent that the shape of the overall ballot box 10 is not limited to being substantially cuboid having a sidewall 14 that is substantially square in cross section, and that any other suitable shape may be used. For example, if a cylindrical ballot box 10 is required, a base having a circular cross section could be used, wherein the panels and struts would be arranged to form a sidewall 14 of substantially circular cross section. It will be apparent that the number and size of panels 22 and struts 20 may be varied in accordance with any desired shape of ballot box 10.

It will be appreciated that the struts 20 and panels 22 may be arranged for an interference fit with one another, or any other arrangement may alternatively be used. It will be further appreciated that the slot 18 is not limited to being provided in the lid 16 and may alternatively be provided in one of the panels 22 or in any other suitable location. More that one slot 18 may be provided in the ballot box 10. It will be still further appreciated that any other combination of one or more transparent, translucent and/or opaque struts 20 and/or panels 22 may be used, as desired for any particular use.

The present invention is not limited to the embodiment described herein, which may be modified or adapted without departing from the scope of the present invention.

The invention claimed is:

1. A ballot box for posting and storing ballots, the ballot box comprising:

a base;

a sidewall secured to the base and defining an interior volume therewith for storing the ballots;

a lid releasably secured to the sidewall and enclosing said interior volume; and a slot provided in the ballot box to enable posting of the ballots into the interior volume;

wherein the sidewall comprises a modular assembly of spaced apart elongate struts extending between the base and the lid and a plurality of panels each disposed between a pair of adjacent struts to enclose said interior volume;

a plurality of elongate rods, each rod being associated with one of said struts and securing said one of said struts to both the base and the lid.

2. A ballot box as claimed in claim 1, wherein each rod further comprises a releasable fastener at an end thereof to permit assembly and disassembly of the box.

3. A ballot box as claimed in claim 2 wherein each rod is in the form of a bolt extending through the strut and each fastener is a complementary nut.

4. A ballot box as claimed in claim 1 wherein each strut comprises a pair of grooves, each adapted to receive an edge of one of the plurality of panels.

5. A ballot box as claimed in claim 4, wherein the pair of grooves on at least one of the struts are directed at right angles to one another and run along the length of said at least one strut, whereby said at least one strut mates with a pair of the panels which are orthogonally directed.

6. A ballot box as claimed in claim 4 wherein the cross section of each strut is generally C-shaped to define a quarter circle having said grooves at either end thereof.

7. A ballot box as claimed in claim 6, wherein the cross section of each strut further comprises a strengthening rib connecting said grooves internally of the quarter circle.

8. A ballot box as claimed in claim 7, wherein the strengthening rib is provided with means for receiving and mating with a respective one of the rods running through the length of the strut.

9. A ballot box as claimed in claim 8 wherein the strengthening rib and the quarter circle surface define in cross section an interior strut volume, and the means for receiving and mating with the rod are internal within this interior strut volume.

10. A ballot box as claimed in claim 1 wherein each strut is an extruded length of material with a constant cross section, which may be cut to any desired length, thereby facilitating the formation of sidewalls of different heights.

11. A ballot box as claimed in claim 1 wherein each panel is an extruded length of material with a constant cross section, which may be cut to any desired length, thereby facilitating the formation of sidewalls of different heights.

12. A ballot box as claimed in claim 1 wherein the panels and the struts are arranged for a press fit with one another.

13. A ballot box as claimed in claim 1 wherein the panels and the struts are arranged for an interference fit with one another.

14. A ballot box as claimed in claim 1 wherein the slot is provided in the lid of the ballot box.

15. A ballot box as claimed in claim 1 wherein the slot is provided in the sidewall of the ballot box.

16. A ballot box as claimed in claim 1 wherein at least one of the side panels is translucent or transparent.

17. A ballot box as claimed in claim 1 wherein at least one of the struts is translucent or transparent.

18. A ballot box as claimed in claim 1 wherein at least one of the side panels or the struts is opaque.

* * * * *